US005399096A

United States Patent [19]

Quillet et al.

[11] Patent Number: 5,399,096

[45] Date of Patent: Mar. 21, 1995

[54] ELECTRICAL CONNECTOR HAVING A THREADED RING AND MEANS FOR RETAINING IT IN LOCKED CONDITION

[75] Inventors: Thierry Quillet, Saint Pavace le Mans; Marisa Vriotte, Chartres; Gérard Boiret, Ivre L'eveque; Christian Camus, Le Mans, all of France

[73] Assignee: Framatome Connectors International, Paris la Defense, France

[21] Appl. No.: 123,688

[22] Filed: Sep. 20, 1993

[30] Foreign Application Priority Data

Sep. 21, 1992 [FR] France ..... 92 11211

[51] Int. Cl.[6] ..... H01R 4/38

[52] U.S. Cl. ..... 439/321; 439/312

[58] Field of Search ..... 439/312–323; 285/81–93; 403/320, 328, 342

[56] References Cited

U.S. PATENT DOCUMENTS 3,917,373 11/1975 Peterson .
4,030,798 6/1977 Paoli .
4,359,254 11/1982 Gallusser et al. ..... 439/321
4,462,265 7/1984 Flederbach et al. ..... 439/314 X
4,536,048 8/1985 Schuildkraut et al. ..... 439/312
4,548,458 10/1985 Gallusser et al. .
4,744,770 5/1988 Drogo ..... 439/310 X
5,199,894 4/1993 Kalny et al. ..... 439/321

FOREIGN PATENT DOCUMENTS 2606949 11/1986 France .

*Primary Examiner*—Khiem Nguyen
*Attorney, Agent, or Firm*—Pollock, Vande Sande & Priddy

[57] ABSTRACT

The electrical connector is connectable to a matching connector and has a body for receiving contacts that carries a threaded rotary locking nut for cooperation with a threaded portion of the matching connector. The nut is fast with internal ratchet teeth having edges each separating a face with a lower slope from a face with a steeper slope relative to a circumferential direction. The body of the connector is non-rotatably connected to a one-piece ring having teeth cooperating with notches formed by the ratchet teeth to establish a ratchet effect that opposes rotation of the ring in an unscrewing direction in which the teeth abut the steeper faces.

5 Claims, 3 Drawing Sheets

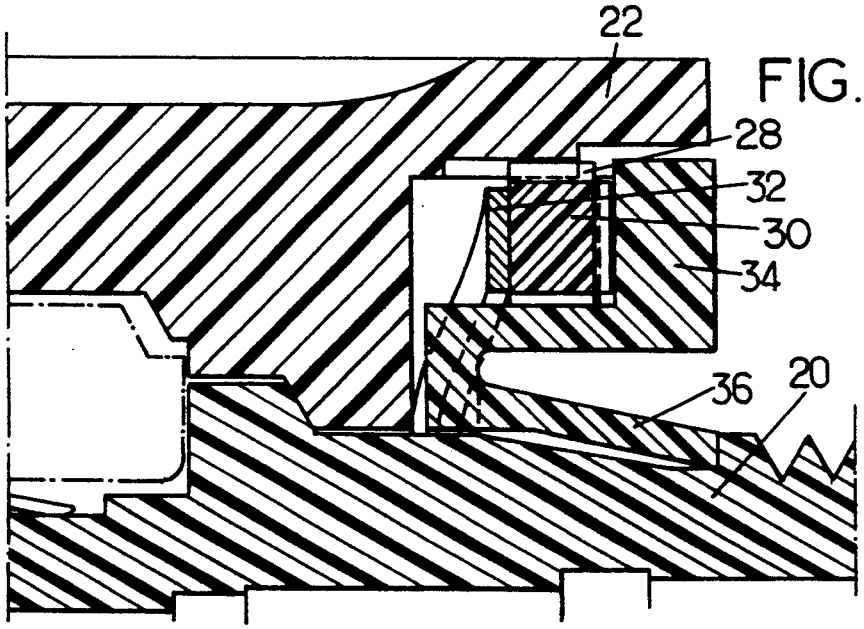
FIG.3.
FIG.6.
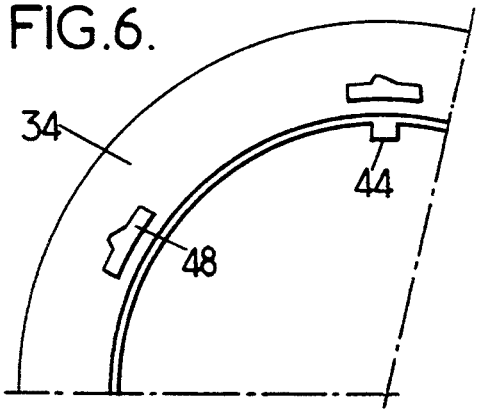
FIG.5.
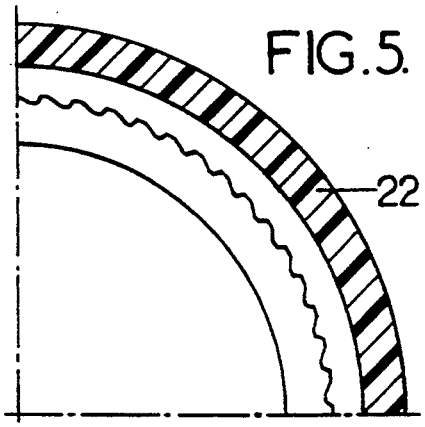
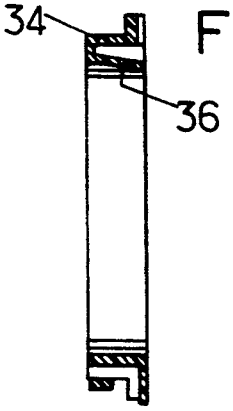
FIG.7.
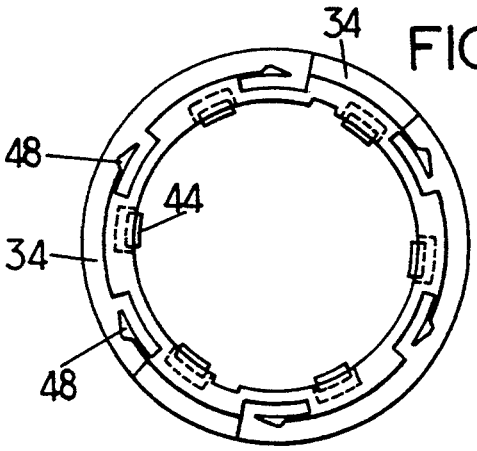
FIG.8.

ELECTRICAL CONNECTOR HAVING A THREADED RING AND MEANS FOR RETAINING IT IN LOCKED CONDITION

BACKGROUND OF THE INVENTION

The invention relates to electrical connectors of the type connectable to a matching connector and having a body for receiving contacts that carries a threaded rotary locking nut for cooperation with a threaded portion of the matching connector, the nut being fast with internal ratchet teeth having edges each separating a face with a lower slope from a face with a steeper slope relative to a circumferential direction, the body of the connector being non-rotatably connected to catch means cooperating with notches formed by the ratchet teeth to establish a ratchet effect that opposes rotation of the ring in an unscrewing direction in which the catch means come into abutment against the steeper faces.

Such connectors may be said to be "self-locking" or "differential force locked" in that the torque to be exerted to unscrew the ring is greater than that required for tightening it. An important application for such connectors is in aviation where vibration is likely to loosen threaded connections and where bayonet-type connections are unsuitable in many cases.

Numerous self-locking connectors are already known in which the catch means are constituted by spring blades, generally of metal, that are designed to abut the steeper faces during uncoupling. Such connectors are complex and/or suffer from the possibility of the spring blades jamming the connector in a fully-coupled condition.

SUMMARY OF THE INVENTION

It is an object of the present invention to provide an electrical connector of the above type that is simple in structure, and that enables a high ratio to be obtained between the screwing (coupling) torque and the unscrewing (uncoupling) torque, without risk of jamming.

To this end, there is provided a connector in which said catch means comprise a one-piece ring of synthetic material having an inner portion for connection with the body and an outer portion carrying additional teeth for engaging said ratchet teeth.

In an advantageous embodiment that renders the coupling force stable over time, the ring includes teeth that are disposed on a radially directed face and the ratchet teeth are formed on a ratchet washer slidably keyed to the nut and urged towards the ring by a resilient member made of metal, that retains its resilient properties over time better than a resilient member made of synthetic material. The resilient metal member may be constituted, in particular, by a wavy spring washer interposed between the ratchet washer and the nut exerting an axial force.

In a simpler embodiment, the one-piece ring has resilient portions designed to come into engagement with a rear shoulder on the body or on a sleeve which is secured thereto so as to hold the ring against axial movement, and it carries resilient fingers integrally formed therewith and having free ends for engaging in internal circumferential ratchet of the ring. The fingers may be axially or tangentially directed.

The invention will be better understood from the following description of connectors constituting particular embodiments of the invention and given as non-limiting examples. The description refers to the accompanying drawings.

BRIEF DESCRIPTION OF THE DRAWINGS

FIG. 3 is a detailed view on a larger scale showing the catch means of the connector of FIGS. 1 and 2;

FIGS. 5 and 6 show respectively a fraction of the locking nut and a fraction of the ring in the connector of FIG. 4, said fractions being as seen on lines V and VI of FIG. 4; and FIGS. 7 and 8 show a modified embodiment of the ring, respectively in cross-section along line VII of FIG. 8 and in front view.

DETAILED DESCRIPTION

Figure 1:
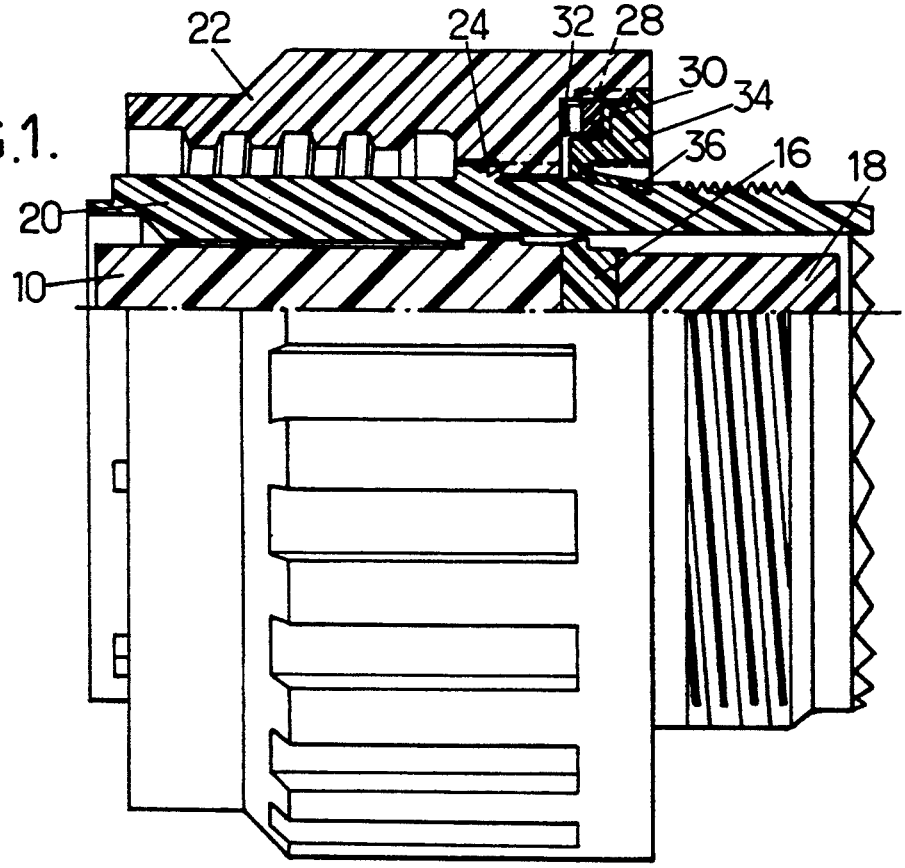
FIG. 1 is a simplified side elevation, partially in cross-section on a plane containing the axis, of a connector that constitutes an advantageous embodiment.
Figure 2:
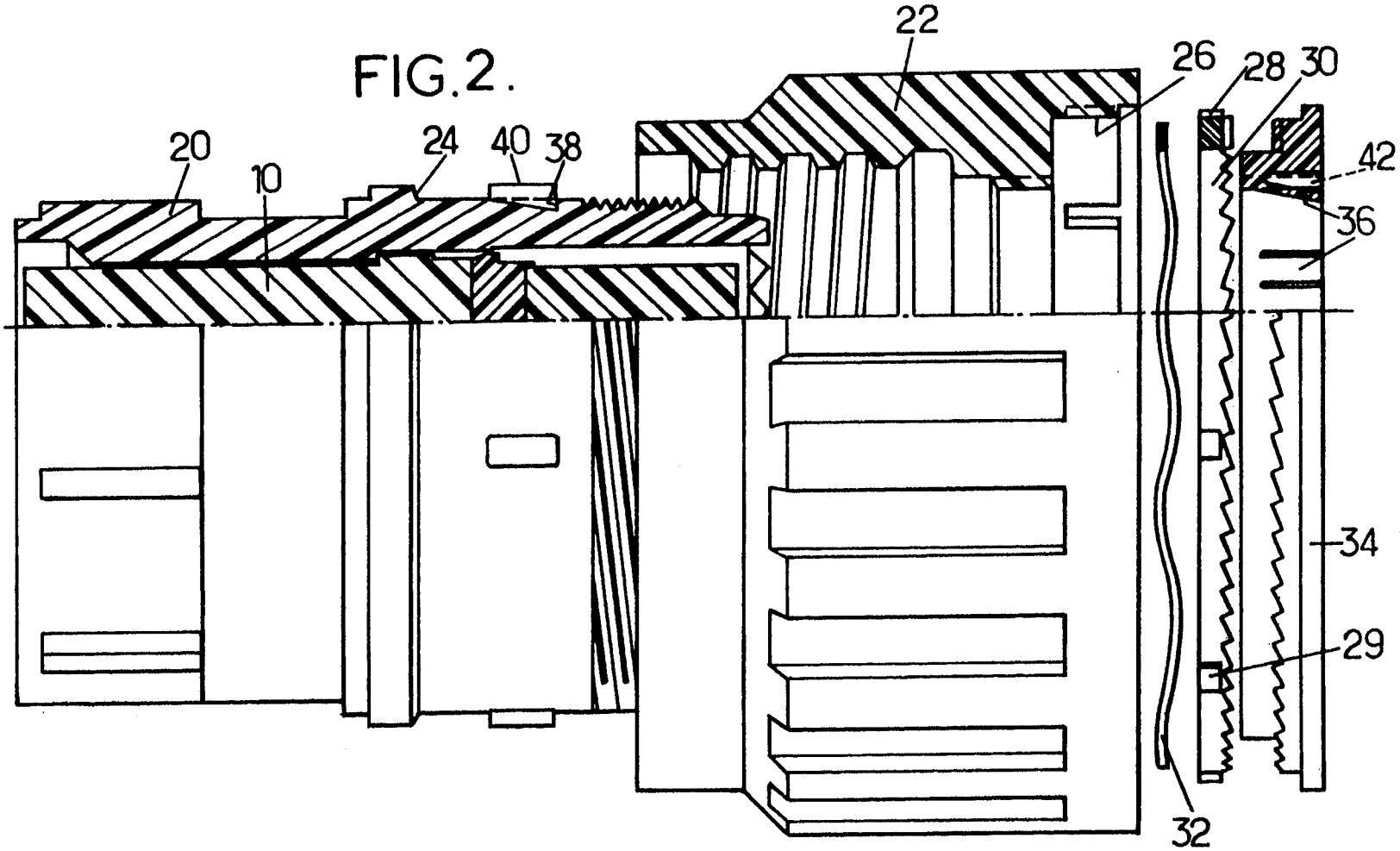
FIG. 2 is an exploded view of the connector of FIG. 1.

The electrical connector shown in FIGS. 1–3 constitutes a plug for coupling to a base that is not shown and whose structure is irrelevant to the present invention providing it has an outer body provided with an external thread. The connector has an insulating body 10 in which passages are formed for receiving electrical contacts 12, which are constituted by sockets in the example shown. The electrical contacts are held in place by any suitable means. As shown, they are held by split rings 14 provided with locking fingers and held in place by a bonded plate 16. A grommet 18 made of a material that is sufficiently deformable to provide sealing may be disposed behind the plate 16. The body, the plate, and the grommet are contained in a sleeve 20 in abutting contact with a swelling of the body.

A locking nut 22 is mounted on the sleeve 20. The nut is internally threaded over a fraction of its length so as to be capable of screw engagement with the thread of the matching connector.

The locking nut 22 is free to rotate on the sleeve 20, but it is retained axially. In the example shown in FIGS. 1 and 2, this is done by abutment of a shoulder of the nut 22 against a circumferential step 24 on the sleeve.

Axially directed notches 26 are formed in the circumferential wall of a rear recess in the ring 22 and receive tabs 28 belonging to a washer 30, so that the washer is slidably keyed in the recess. The rear surface (in the axial direction) of washer 30 has ratchet teeth formed thereon in which each tooth has an edge between a face having a gentle slope and a face having a steep slope relative to the circumferential direction. The slidable keying constrains the washer 30 and the ratchet teeth to rotate together with the locking nut 22. The ratchet washer 30 is urged rearwardly by resilient means that are constituted in FIGS. 1 and 2 by a wavy spring washer 32 which is made of metal whereas the ratchet washer may be made of synthetic material.

The spring washer 32 presses the ratchet washer 30 against catch means constituted by a ring 34 which is prevented from moving both in rotation and axially relative to the sleeve 20 and that carries regularly spaced-apart teeth facing the ratchet washer. It is retained against axial movement by resilient locking fingers 36 integrally formed with the remainder of the ring 34 and engaging notches or a circumferential groove 38 formed in in the sleeve and having a disymmetrical cross-section. It is secured against rotation relative to the sleeve and thus relative to the body 10 by slidable keying constituted by radial projections 40 of the sleeve and corresponding slots 42 in the ring 34. Displacement of the ring in the opposite direction to the abutment of the resilient locking fingers 36 is limited by abutment of the ring against the locking nut 22 (FIG. 1). In practice, the thickness of the ring is such that it is stationary relative to the sleeve 20.

Figure 4:
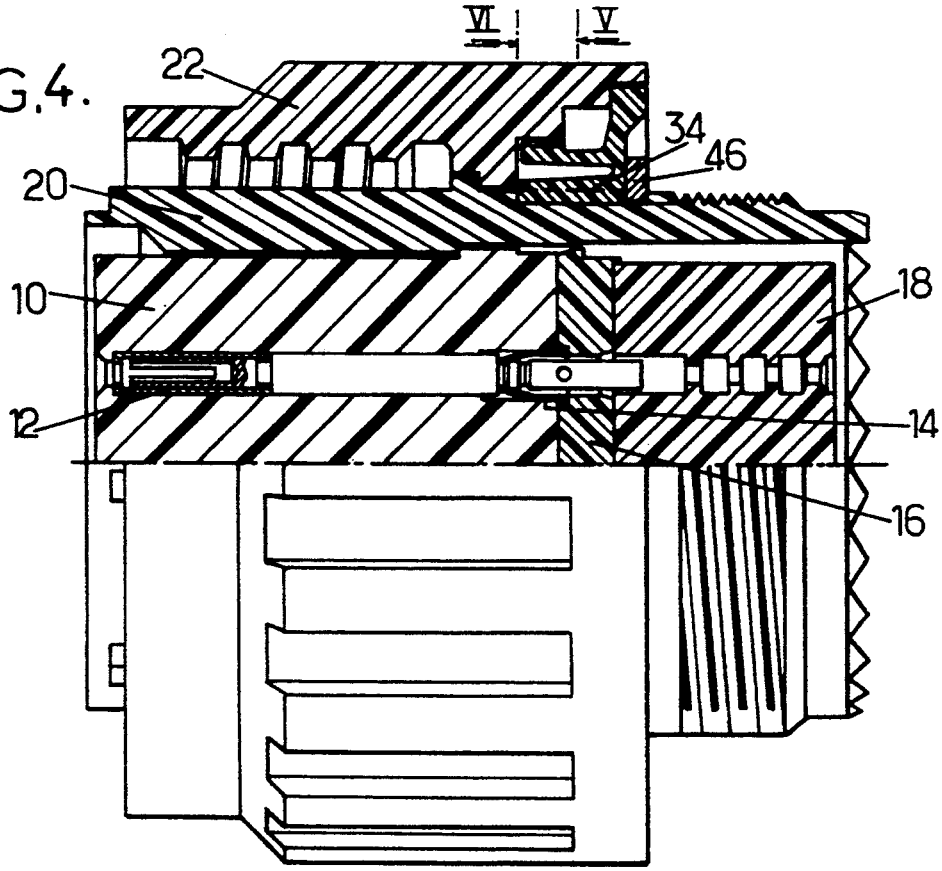
FIG. 4 is similar to FIG. 1 and shows another embodiment.

In the modified embodiment of the invention shown in FIG. 4 (where components corresponding to those of FIGS. 1 to 3 are designated by the same reference numerals), the ratchet teeth are radially directed rather than axially directed and the ring 34 provides all catch functions, i.e. it includes teeth that engage the ratchet teeth and the resilient means urging the teeth into mutual engagement. FIGS. 4 and 5 show the internal ratchet integrally molded with the locking nut 22. The ring 34 (FIGS. 4 and 6) includes internal projections 44 for engaging slots in the sleeve so as to provide slidable keying. The ring is held longitudinally in abutment against a shoulder of the sleeve by a resilient split ring or circlip, generally made of metal. The teeth of the ring 34 are constituted by the terminal portions of resilient fingers 48 integrally formed with the remainder of the ring and capable of bending resiliently. Like the internal ratchet teeth formed directly on the locking nut 22, the teeth have an assymmetrical profile, as can be seen in FIGS. 5 and 6.

FIGS. 7 and 8 show a modified embodiment of the ring 34, which includes fingers for retention on the sleeve making the split ring 46 unnecessary. Unlike the tabs 48 in the embodiment of FIGS. 4 and 6, the tabs 48 shown in FIGS. 7 and 8 extend circumferentially. The ring 34 again includes keying projections 44 for engaging slots in the sleeve.

We claim:

1. Electrical connector having:

body means for receiving electrical contacts;

a threaded rotary locking nut for cooperation with a threaded portion of a matching connector, said locking nut being retained against forward axial movement beyond a predetermined position on said body means;

a ratchet washer axially slidable on and non-rotatably connected to said nut and formed with axially directed ratchet teeth having edges each separating a cam face with a lower slope from a ratchet face with a steeper slope relative to a circumferential direction;

a separate one-piece ring of synthetic material having a radially inner portion for secured connection with said body means and an outer portion formed with additional teeth for engaging said ratchet teeth to establish a ratchet effect that opposes rotation of the ring in an unscrewing direction in which the additional teeth come into abutment against the steeper sloping ratchet faces; and a spring wavy metal washer interposed between said ratchet washer and said nut for exerting an axially directed force on said ratchet washer applying the latter against said ring.

2. Connector according to claim 1, wherein:

said radially inner portion of said one-piece ring is formed with a plurality of angularly distributed resilient locking fingers integral therewith and with axial slots; and said body means are formed with circumferential groove means for receiving said resilient locking fingers and preventing axially rearward movement of said ring with respect to said body means and with radial projections engaging into said axial slots for preventing rotation of said ring relative to said body means.

3. Electrical connector according to claim 1, wherein said ratchet washer is of synthetic material.

4. Electrical connector having:

body means for receiving contacts;

a threaded rotary locking nut for cooperation with a threaded portion of a matching connector, said locking nut being rotatably supported by said body means, being retained against forward movement with respect to said body means by abutment means and being formed with radially inwardly directed circumferentially distributed ratchet teeth having edges each separating a cam face with a lower slope from a ratchet face with a steeper slope relative to a circumferential direction;

a separate one-piece ring of synthetic material securely and non-rotatably connected to said body means and having cantilever resilient fingers integrally formed therewith and each having an end radially engaging said ratchet teeth due to the resiliency thereof.

5. Electrical connector according to claim 4, wherein said one-piece ring is slidably keyed on said body means and is retained against a shoulder of said body means by a split ring seated in a groove of said body means.

* * * * *